US008380108B2

(12) United States Patent
Isahai et al.

(10) Patent No.: US 8,380,108 B2
(45) Date of Patent: Feb. 19, 2013

(54) FIXING DEVICE AND IMAGE FORMING APPARATUS

(75) Inventors: Satoshi Isahai, Saitama (JP); Yasuki Tanaka, Kanagawa (JP); Yukihiro Ichiki, Kanagawa (JP); Yasuo Suzuki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 220 days.

(21) Appl. No.: 12/871,694

(22) Filed: Aug. 30, 2010

(65) Prior Publication Data

US 2011/0236068 A1 Sep. 29, 2011

(30) Foreign Application Priority Data

Mar. 23, 2010 (JP) ..... 2010-066814

(51) Int. Cl.
*G03G 15/16* (2006.01)
*G03G 15/00* (2006.01)

(52) U.S. Cl. ..... 399/122; 399/405

(58) Field of Classification Search ..... 399/122, 399/401, 402, 405
See application file for complete search history.

(56) References Cited

U.S. PATENT DOCUMENTS

| | | | | |
|---|---|---|---|---|
| 5,481,348 | A | 1/1996 | Mihara et al. | |
| 7,437,096 | B2 * | 10/2008 | Ito et al. | 399/122 |
| 2006/0008294 | A1 | 1/2006 | Ito et al. | |
| 2009/0022515 | A1 | 1/2009 | Ito et al. | |

FOREIGN PATENT DOCUMENTS

| | | | |
|---|---|---|---|
| JP | 6-118739 | A | 4/1994 |
| JP | 2007-17489 | A | 1/2007 |

* cited by examiner

*Primary Examiner* — Hoang Ngo
(74) *Attorney, Agent, or Firm* — Sughrue Mion, PLLC

(57) ABSTRACT

A fixing device includes a main body mounted on an image forming apparatus body; a fixing member that is included in the main body and that fixes an image to a recording medium; a pair of conveying rolls that is supported by the main body and that conveys the recording medium to which an image is fixed by the fixing member, the pair of conveying rolls comprising a driven roll and a driving roll disposed under the driven roll; and an exterior portion that is formed in the main body, disposed under the driving roll, forms an exterior face of the main body, and also forms an exterior face of the image forming apparatus body while the main body is mounted on the image forming apparatus body.

5 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2010-066814 filed on Mar. 23, 2010.

BACKGROUND

1. Technical Field

The present invention relates to a fixing device and an image forming apparatus.

2. Related Art

Configurations of an image formation device in which a fixing unit can be exchanged without interfering with an eject tray member have been proposed.

SUMMARY

An aspect of the invention provides A fixing device including a main body mounted on an image forming apparatus body; a fixing member that is included in the main body and that fixes an image to a recording medium; a pair of conveying rolls that is supported by the main body and that conveys the recording medium to which an image is fixed by the fixing member, the pair of conveying rolls comprising a driven roll and a driving roll disposed under the driven roll; and an exterior portion that is formed in the main body, disposed under the driving roll, forms an exterior face of the main body, and also forms an exterior face of the image forming apparatus body while the main body is mounted on the image forming apparatus body.

BRIEF DESCRIPTION OF THE DRAWINGS

Exemplary embodiments of the present invention will be described in detail based on the following figures, wherein.

DETAILED DESCRIPTION

Configuration of Image Forming Apparatus

Figure 1:
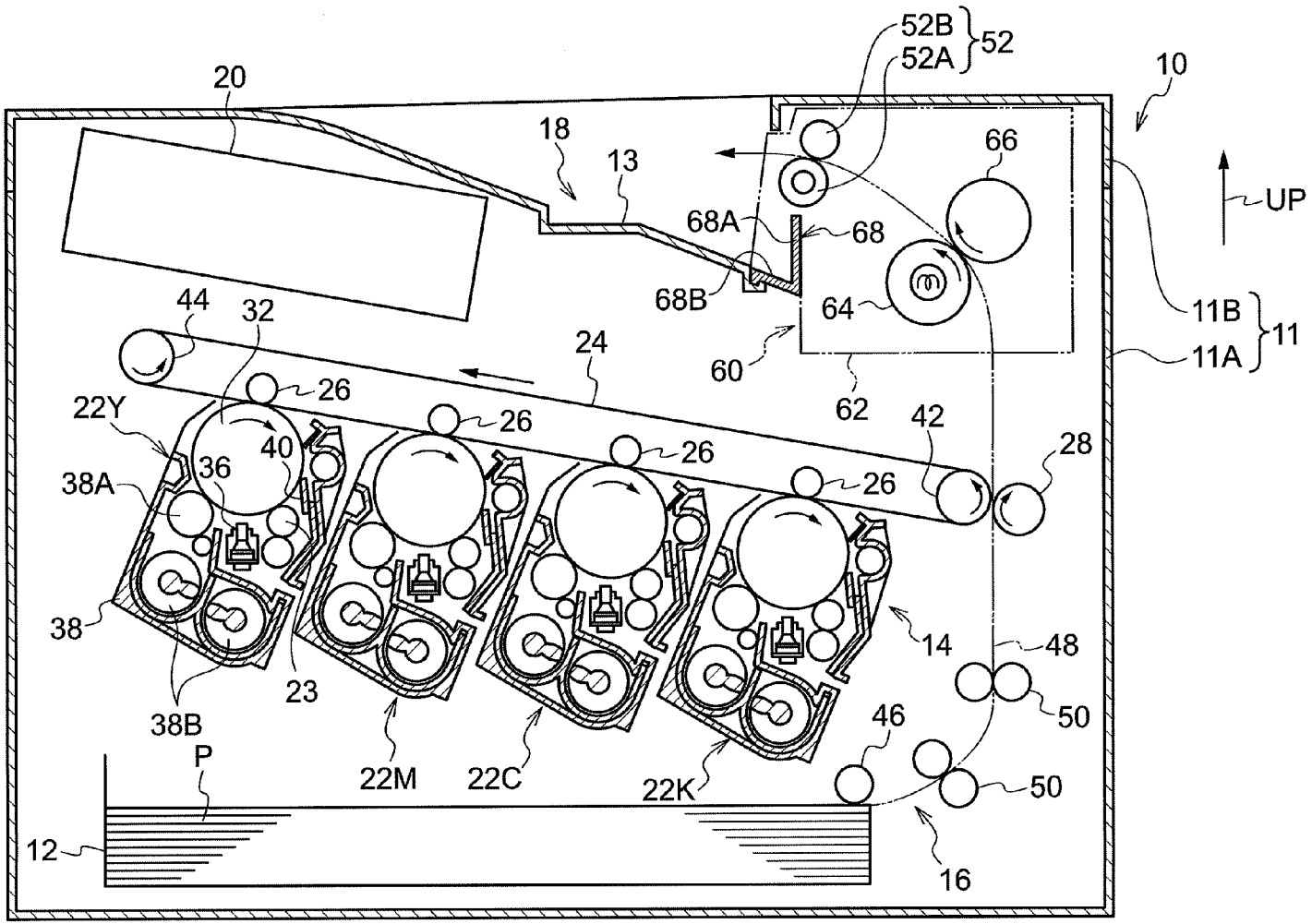
FIG. 1 is a schematic view showing a configuration of an image forming apparatus according to an exemplary embodiment.

First, a configuration of an image forming apparatus according the exemplary embodiment will be described. FIG. 1 is a schematic view showing the configuration of the image forming apparatus according to the exemplary embodiment. The arrow UP shown in FIG. 1 shows the upper side in the vertical direction.

As shown in FIG. 1, the image forming apparatus 10 includes a main body 11 accommodating therein each component thereof. The main body 11 includes a housing 11A having an opened upper portion and an upper cover 11B (which is an example of an exterior portion in the image forming apparatus 10) as an example of a covering member covering the opened upper portion of the housing 11A.

The main body 11 includes therein an accommodating section 12 which accommodates the recording media P such as sheets, an image formation section 14 which forms an image on the recording medium P, a conveying section 16 which conveys the recording medium P from the accommodating section 12 to the image formation section 14, and a controller 20 which controls the operation of each section of the image forming apparatus 10. An ejecting section 18 to which the recording medium P formed with an image by the image formation section 14 is ejected is provided at the upper portion of the main body 11.

The image formation section 14 includes image forming units 22Y, 22M, 22C, and 22K (hereinafter shown as 22Y to 22K) that respectively form a toner image of each color of yellow (Y), magenta (M), cyan (C), and black (K), an intermediate transfer belt 24 to which the toner images formed at the image forming units 22Y to 22K are transferred, a first transfer roll 26 that transfers the toner images formed by the image forming units 22Y to 22K to the intermediate transfer belt 24, and a second transfer roll 28 that transfers the toner images transferred to the intermediate transfer belt 24 by the first transfer roll 26 to the recording medium P. The configuration of the image formation section 14 is not limited to the above and may have a different configuration as long as an image can be formed on the recording medium P.

The image forming units 22Y to 22K are arranged in line at the center position in the vertical direction of the image forming apparatus 10 having a tilted attitude with respect to the horizontal direction. Each of the image forming units 22Y to 22K has a photoreceptor 32 which rotates in a predetermined direction (for example, in a clockwise direction in FIG. 1). Since the image forming units 22Y to 22K are all configured similarly, the reference numeral for each component in the image forming units 22M, 22C, and 22K is omitted in FIG. 1. Around each of the photoreceptors 32, a charging roll 23 as an example of a charging device that charges the photoreceptor 32, an exposure device 36 which exposes the photoreceptor 32 charged by the charging roll 23 and forms an electrostatic latent image on the photoreceptor 32, a developing device 38 which develops the electrostatic latent image formed on the photoreceptor 32 by the exposure device 36 and forms a toner image, and a removing member 40 which contacts the photoreceptor 32 and removes a toner remaining on the photoreceptor 32 are sequentially provided from the upstream side in the rotating direction of the photoreceptor 32.

The exposure device 36 forms an electrostatic latent image based on an image signal transmitted from the controller 20. The image signal transmitted from the controller 20 may be an image signal obtained from an external apparatus by the controller 20.

The developing device 38 includes a developer feeder 38A that supplies a developer to the photoreceptor 32, and plural conveying members 38B that conveys the developer applied to the developer feeder 38A while agitating the developer.

As shown in FIG. 1, the intermediate transfer belt 24 is formed in an annular (loop) shape and is disposed at the upper side of the image forming units 22Y to 22K. Winding rolls 42 and 44 around which the intermediate transfer belt 24 is wound are disposed at the inner peripheral side of the intermediate transfer belt 24. Due to any one of the winding rolls 42 and 44 is driven to rotate, the intermediate transfer belt 24 circulates and moves (rotates) in a predetermined direction (for example, in a counterclockwise direction in FIG. 1) while contacting the photoreceptor 32. The winding roll 42 functions as a facing roll that faces the second transfer roll 28.

The first transfer roll 26 faces the photoreceptor 32 with the intermediate transfer belt 24 disposed therebetween. A position between the first transfer roll 26 and the photoreceptor 32 is a first transfer position where a toner image formed on the photoreceptor 32 is transferred onto the intermediate transfer belt 24.

The second transfer roll 28 faces the winding roll 42 with the intermediate transfer belt 24 disposed therebetween. A position between the second transfer roll 28 and the winding roll 42 is a second transfer position where the toner image transferred onto the intermediate transfer belt 24 is transferred to the recording medium P.

The conveying section 16 includes a feed roll 46 that feeds the recording medium P accommodated in the accommodating section 12, a conveyance passage 48 through which the recording medium P fed by the feed roll 46 is conveyed, plural conveying rolls 50 disposed along the conveyance passage 48 and conveys the recording medium P fed by the feed roll 46 to the second transfer position.

A fixing device 60 is provided at the downstream side in the conveying direction from the second transfer position. The fixing device 60 fixes the toner image, which is transferred from the intermediate transfer belt 24 onto the recording medium P by the second transfer roll 28, to the recording medium P. The fixing device 60 is provided with an ejection roll 52 ejecting the recording medium P to which the toner image has been fixed to the ejecting section 18. A specific configuration of the fixing device 60 will be described later.

Next, a description will be given of an image forming operation that forms an image on the recording medium P in the image forming apparatus 10.

In the image forming apparatus 10, the recording medium P fed by the feed roll 46 from the accommodating section 12 is fed into the second transfer position by the plural conveying rolls 50.

In each of the image forming units 22Y to 22K, the photoreceptor 32 charged by the charging roll 23 is exposed by the exposure device 36, and an electrostatic latent image is formed on the photoreceptor 32. The respective electrostatic latent image is developed by the developing device 38 and a toner image is formed on the photoreceptor 32. The toner image of each color formed in each of the image forming units 22Y to 22K is overlapped on the intermediate transfer belt 24 at the first transfer position, thereby forming a color image. The color image formed on the intermediate transfer belt 24 is then transferred to the recording medium P at the second transfer position.

The recording medium P to which the toner image is transferred is conveyed to the fixing device 60, and the transferred toner image is fixed by the fixing device 60. The recording medium P to which the toner image is fixed is ejected to the ejecting section 18 by the ejection roll 52. A series of image forming operation is performed as described above.

Configuration of Fixing Device

Figure 2:
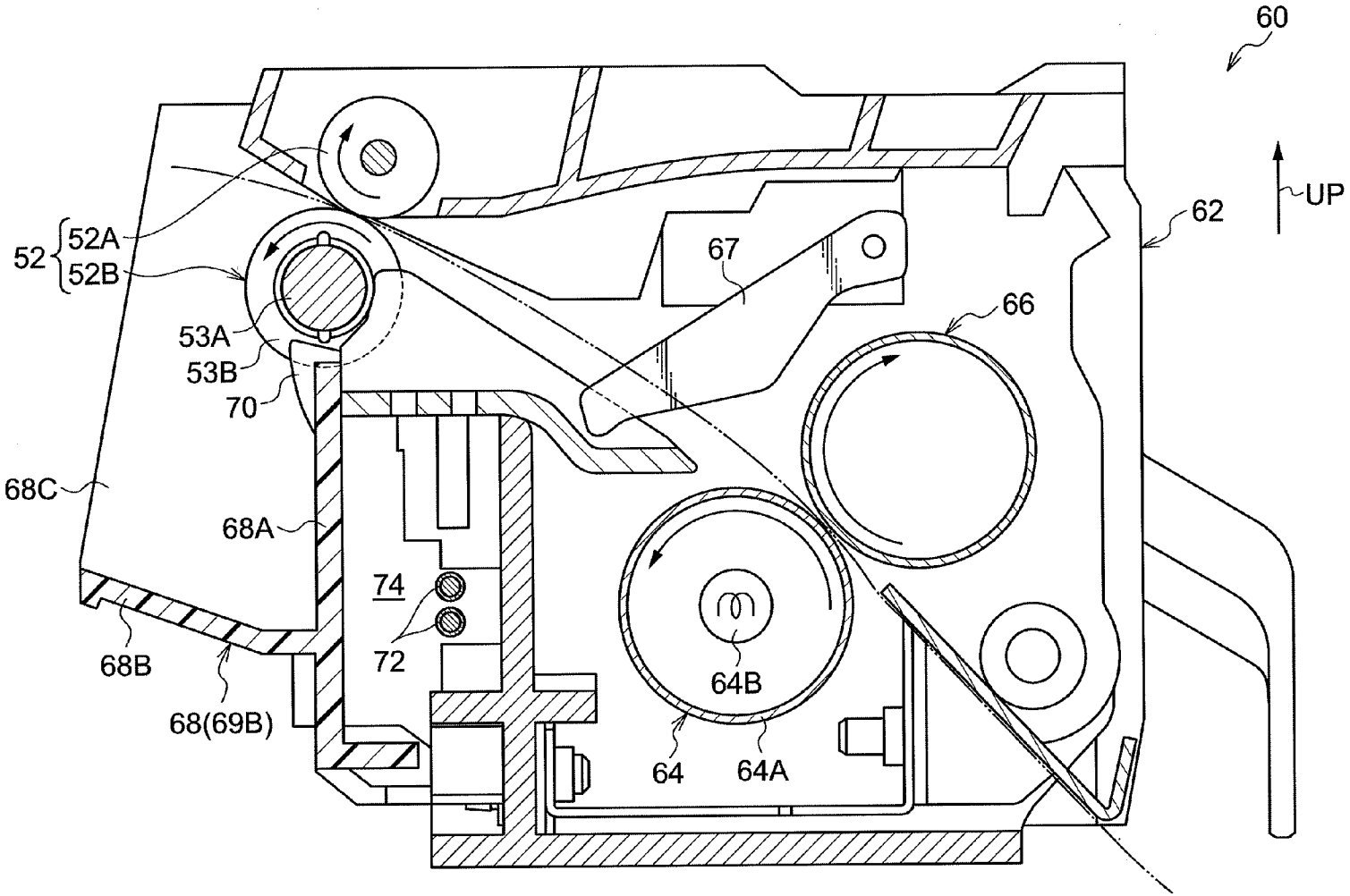
FIG. 2 is a cross-sectional view showing a configuration of a fixing device according to the exemplary embodiment.

Next, a configuration of the fixing device 60 according to the exemplary embodiment will be described. FIGS. 2 to 5 are schematic views showing the configuration of the fixing device 60 according to the exemplary embodiment. The arrow UP shown in FIG. 2 shows the upper side in the vertical direction.

As shown in FIG. 2, the fixing device 60 can be attached and detached to and from the main body 11 and has a main body 62 including each component thereof. The main body 62 includes a heating roll 64 and a pressure belt 66 as examples of fixing members that fix a toner image onto the recording medium P.

The heat roll 64 includes a cylindrical member 64A rotatably supported by the main body 62 and a heat source 64B such as a halogen lamp provided inside the cylindrical member 64A. The pressure belt 66 is formed into an annular (loop) shape and is rotatably supported by the main body 62 at a position facing the heating roll 64.

In the heating roll 64 and the pressure belt 66, due to the heating roll 64 is driven and rotated and the pressure belt 66 is rotated by following the heating roll 64, the recording medium P on which a toner image is transferred is conveyed while being held between the heating roll 64 and the pressure belt 66. Thus, while the recording medium P is held between the heating roll 64 and the pressure belt 66 and conveyed, the heating roll 64 applies heat to the toner and the pressure belt 66 applies pressure to the toner, whereby the toner image is fixed.

As an example of a pair of conveying rolls that conveys the recording medium P to which a toner image is fixed by the heating roll 64 and the pressure belt 66, a pair of ejection rolls 52 that ejects the recording medium P from the main body 62 to the ejecting section 18 is provided in the main body 62. The pair of ejection rolls 52 includes a driven roll 52A and a driving roll 52B disposed under the driven roll 52A.

Figure 3:
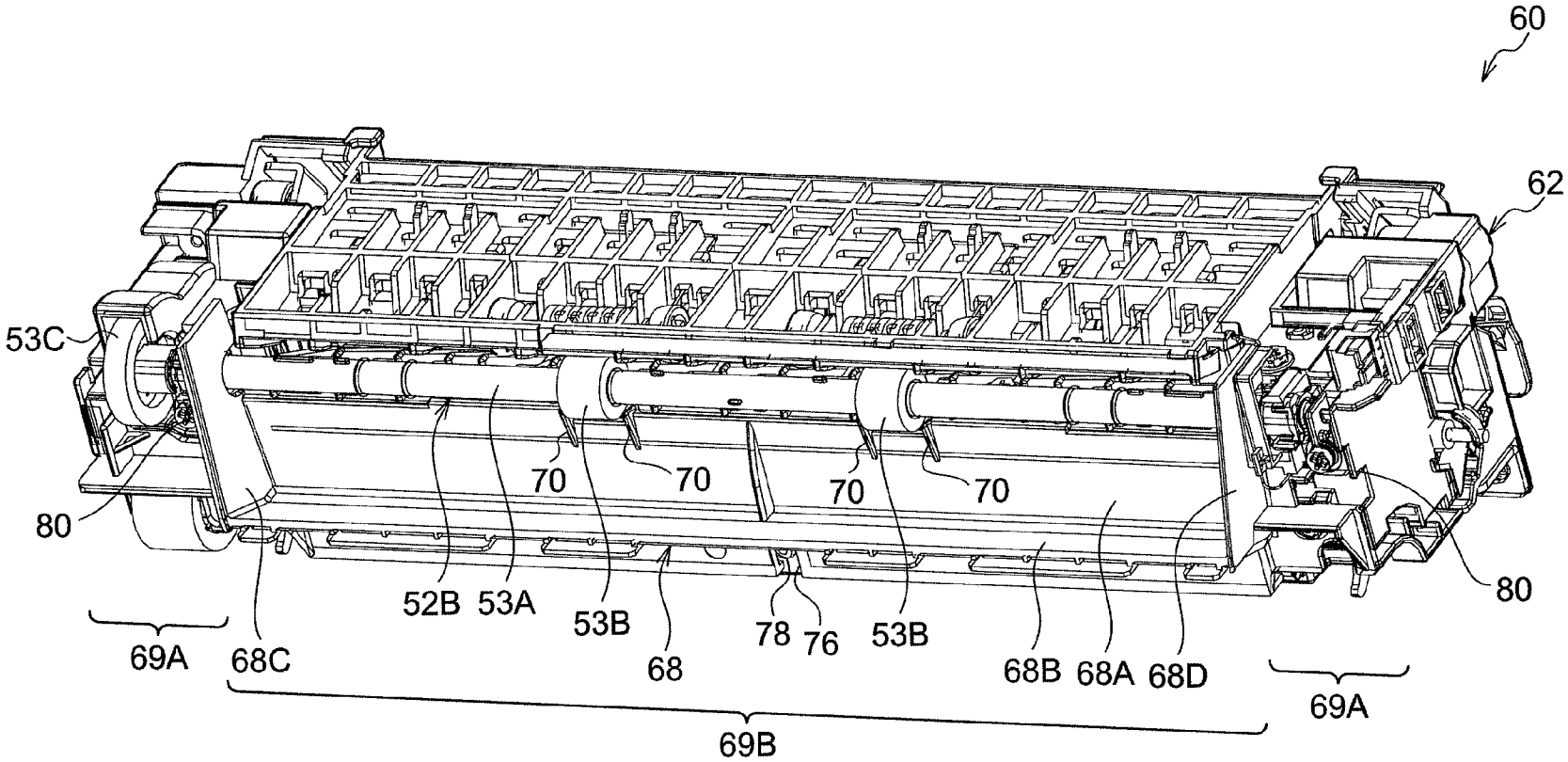
FIG. 3 is a perspective view showing a configuration of the fixing device according to the exemplary embodiment.
Figure 4:
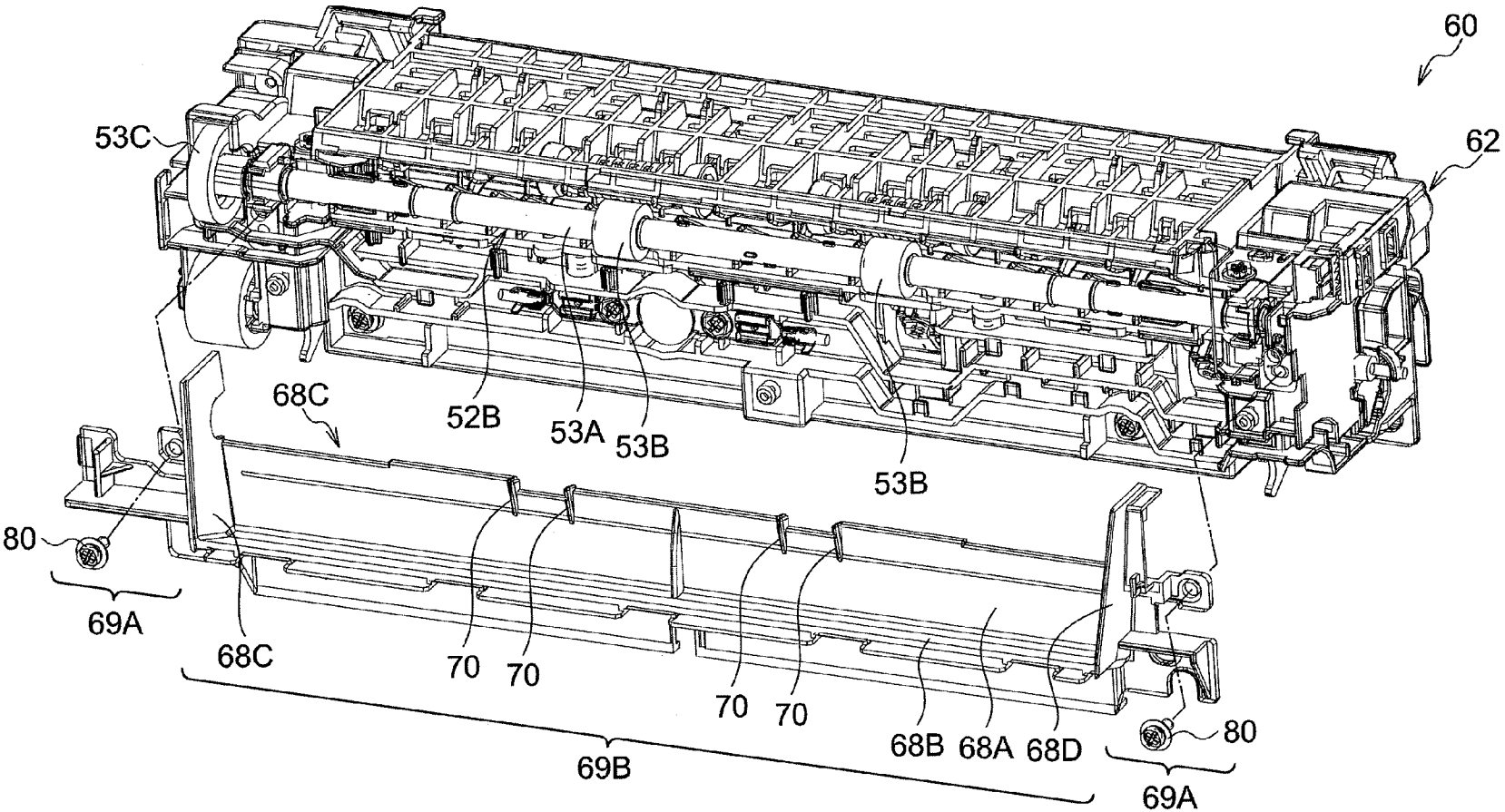
FIG. 4 is an exploded perspective view showing a configuration of the fixing device according to the exemplary embodiment.
Figure 5:
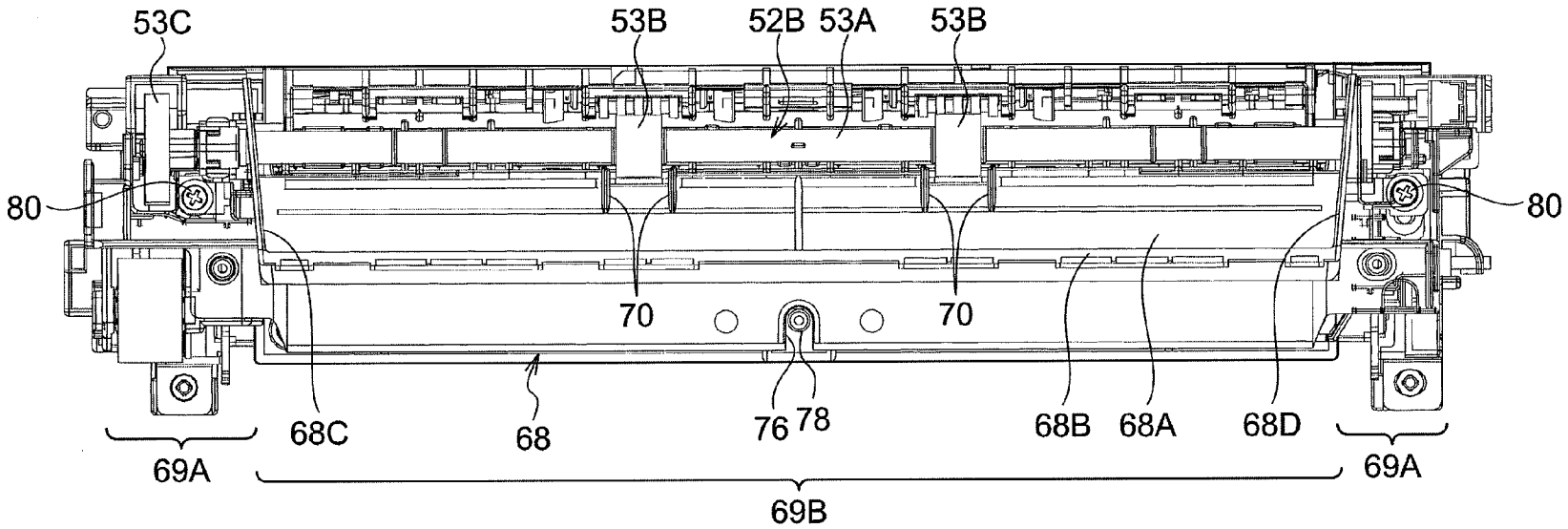
FIG. 5 is a front view showing a configuration of the fixing device according to the exemplary embodiment.

The driving roll 52B includes a drive shaft 53A and roller members 53B provided around the drive shaft 53A. As shown in FIGS. 3, 4, and 5, a gear 53C is attached at one end in the axial direction of the drive shaft 53A. The gear 53C is an example of a transmission member that transmits a driving force from a drive motor (not shown) to the drive shaft 53A.

In FIG. 2, a conveyance passage through which the recording medium P is conveyed by the pair of ejection rolls 52, the heating roll 64, and the pressure belt 66 is shown by the two-dot chain line. Along this conveyance passage, a detection piece 67 which is an example of a detector that detects the recording medium P is provided between the heating roll 64 and the pressure belt 66 and the pair of ejection rolls 52.

Figure 6:
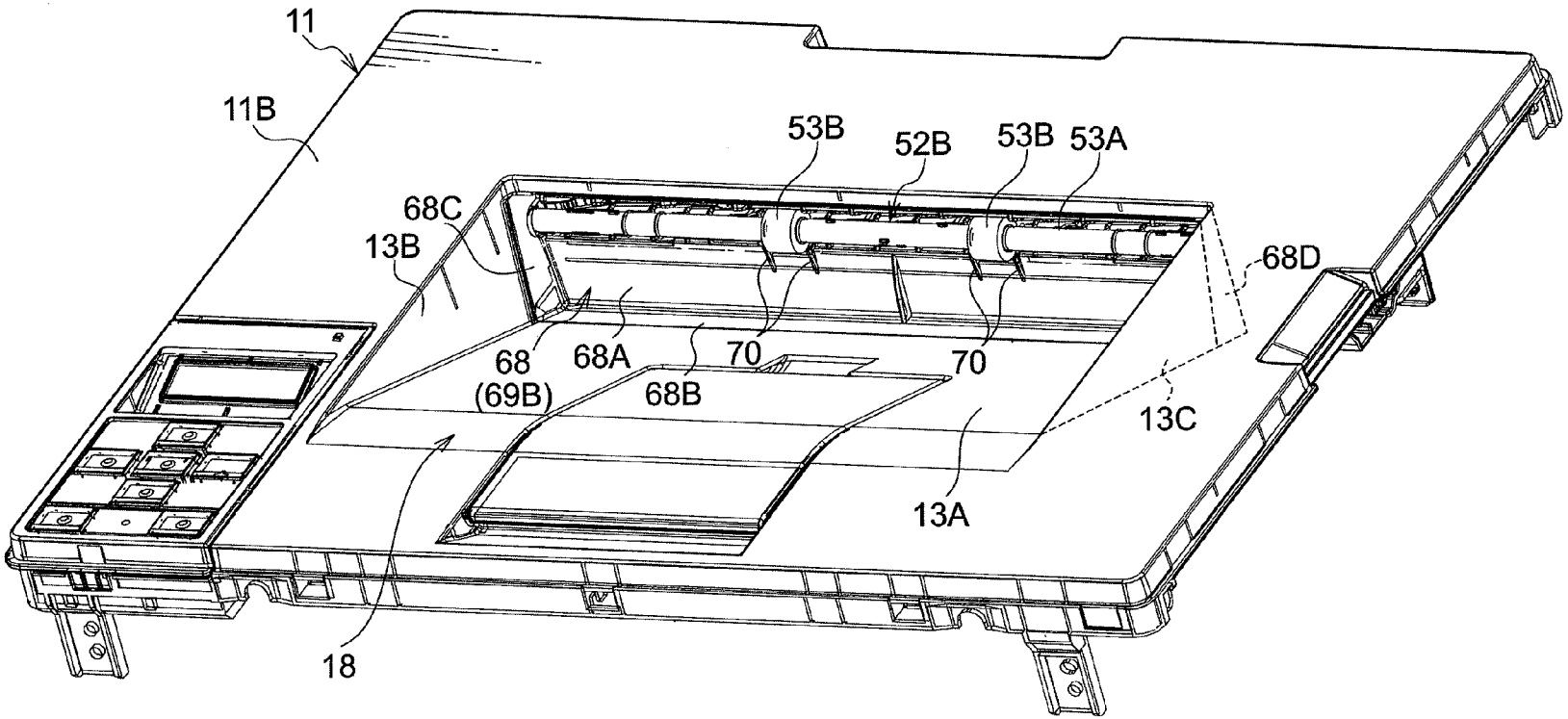
FIG. 6 is a perspective view showing a state in which a fixing device body is mounted on an image forming apparatus body, according to the exemplary embodiment.

As shown in FIG. 6, the main body 62 includes an exterior cover 68 as an example of an exterior portion, which constitutes an exterior face of the main body 62 and, in a state in which the main body 62 is mounted on the main body 11, also constitutes as an exterior face of the main body 11.

As shown in FIGS. 3, 4, and 5, the exterior cover 68 includes fixing portions 69A, which are disposed on the respective ends in the axial direction of the driving roll 52B and fixed to the main body 62, and an exterior portion 69B, which constitutes the exterior face of the main body 11 when the main body 62 is mounted on the main body 11. The fixing portion 69A and the exterior portion 69B constitute the exterior face of the main body 62. Namely, the entire exterior cover 68 constitutes the exterior face of the main body 62, and further, the exterior cover 68 partially constitutes the exterior face of the main body 11.

As shown in FIGS. 3, 4, and 5, the exterior cover 68 is positioned with respect to the main body 62 by the fixing portion 69A, and is fixed to the main body 62 by a screw 80 which is an example of a fixing member. A recess 76 formed at the lower end of the exterior cover 68 at the center portion in the axial direction of the driving roll 52B is engaged with a projection 78 projecting at the lower portion of the main body 62. According to this configuration, the deformation of the exterior cover 68 due to a load applied to the exterior cover 68 is suppressed.

As shown in FIG. 6, the exterior portion 69B of the exterior cover 68 constitutes a part of the ejecting section 18 to which the recording medium P is ejected by the pair of the ejection rolls 52. Specifically, the exterior portion 69B of the exterior cover 68 includes a first cover 68A disposed on the lower side of the driving roll 52B and constituting the front surface of the ejecting section 18, a second cover 68B constituting a part of the bottom surface of the ejecting section 18, and third covers 68C and 68D constituting a part of the side surface of the ejecting section 18.

Thus, the bottom surface of the ejecting section 18 is configured by a combination of the second cover 68B (which is an example of a first bottom surface) provided at the fixing device 60 and a bottom surface cover 13A (which is an example of a second bottom surface) provided at the main body 11. The side surface of the ejecting section 18 is configured by a combination of the third covers 68C and 68D (which are an example of a first side surface) provided at the fixing device 60 and side surface covers 13B and 13C (which are an example of a second side surface) provided at the main body 11. The exterior cover 68 and the bottom surface cover 13A are produced by molding the same resin material.

Figure 7:
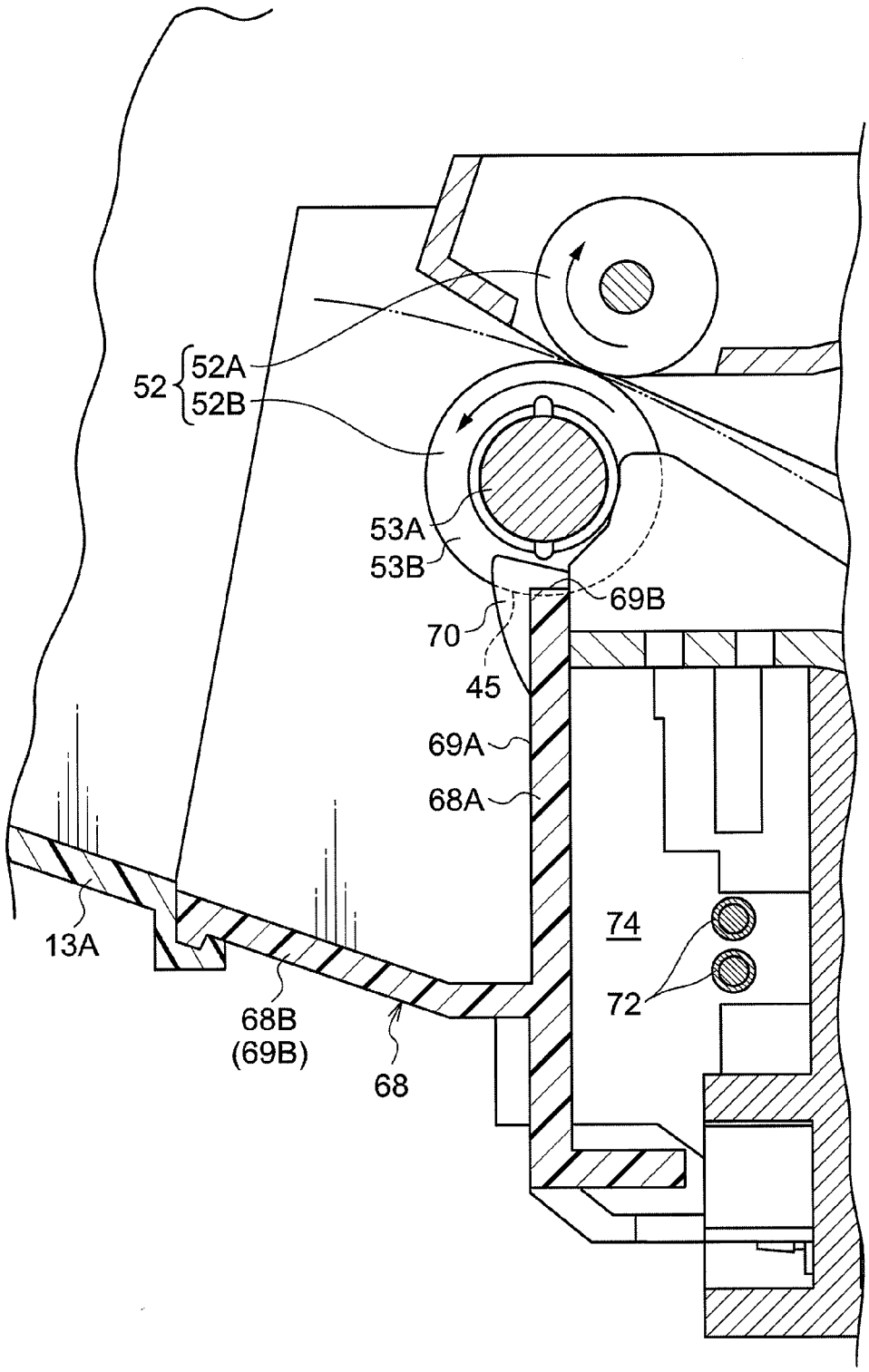
FIG. 7 is a schematic view showing a step formed between a bottom surface cover at the image forming apparatus and a second cover at the fixing device, according to the exemplary embodiment.

As shown in FIG. 7, the second cover 68B provided at the fixing device 60 is positioned lower than the bottom surface cover 13A provided at the image forming apparatus 10 when the main body 62 is mounted on the main body 11. According to this configuration, a step portion is formed between the bottom surface cover 13A at the image forming apparatus 10 and the second cover 68B at the fixing device 60 such that the second cover 68B at the fixing device 60 is lower than the bottom surface cover 13A at the image forming apparatus 10.

Figure 8:
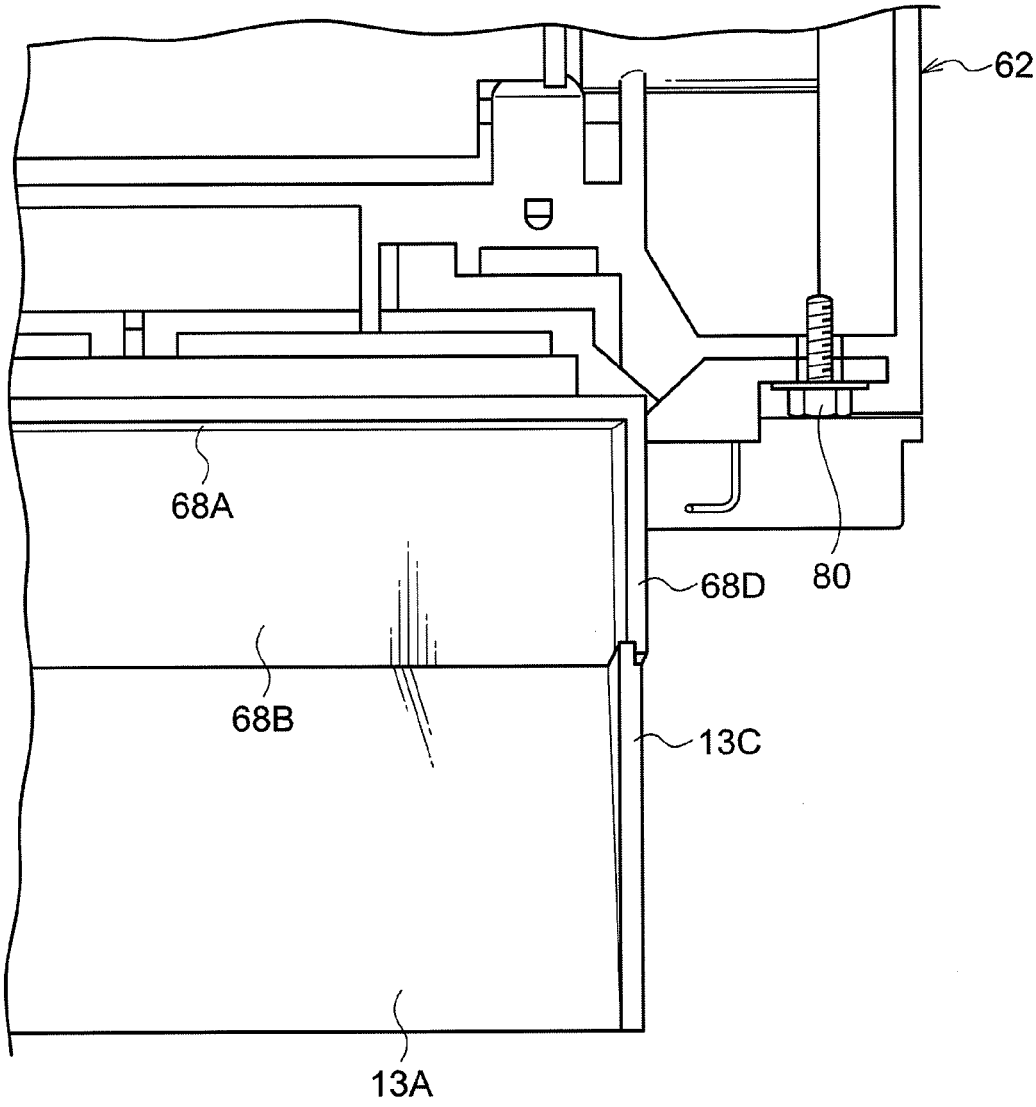
FIG. 8 is a schematic view showing a step formed between a side surface cover at the image forming apparatus and a third cover at the fixing device, according to the exemplary embodiment.

As shown in FIG. 8, when the main body 62 is mounted on the main body 11, the third covers 68C and 68D provided at the fixing device 60 are positioned further to the outer side than the side surface covers 13B and 13C provided at the image forming apparatus 10, that is, positioned at the side separating from the side end of the recording medium P ejected to the ejecting section 18 (i.e., the right side in FIG. 8). According to this configuration, a step portion is formed both between the side surface cover 13B at the image forming apparatus 10 and the third cover 68C at the fixing device 60 and between the side surface cover 13C at the image forming apparatus 10 and the third cover 68D at the fixing device 60 such that the third covers 68C and 68D at the fixing device 60 are retracted further to the outer side than the side surface covers 13B and 13C at the image forming apparatus 10 (i.e., the third covers 68C and 68D at the fixing device 60 are positioned at a position farther than that of the side surface covers 13B and 13C of the image forming apparatus body, in an axis direction of the pair of ejecting rolls from an axis direction center thereof). Note that in FIG. 8, although only the third cover 68D and the side surface cover 13C are illustrated, the third cover 68C and the side surface cover 13B have a similar configuration.

Figure 9:
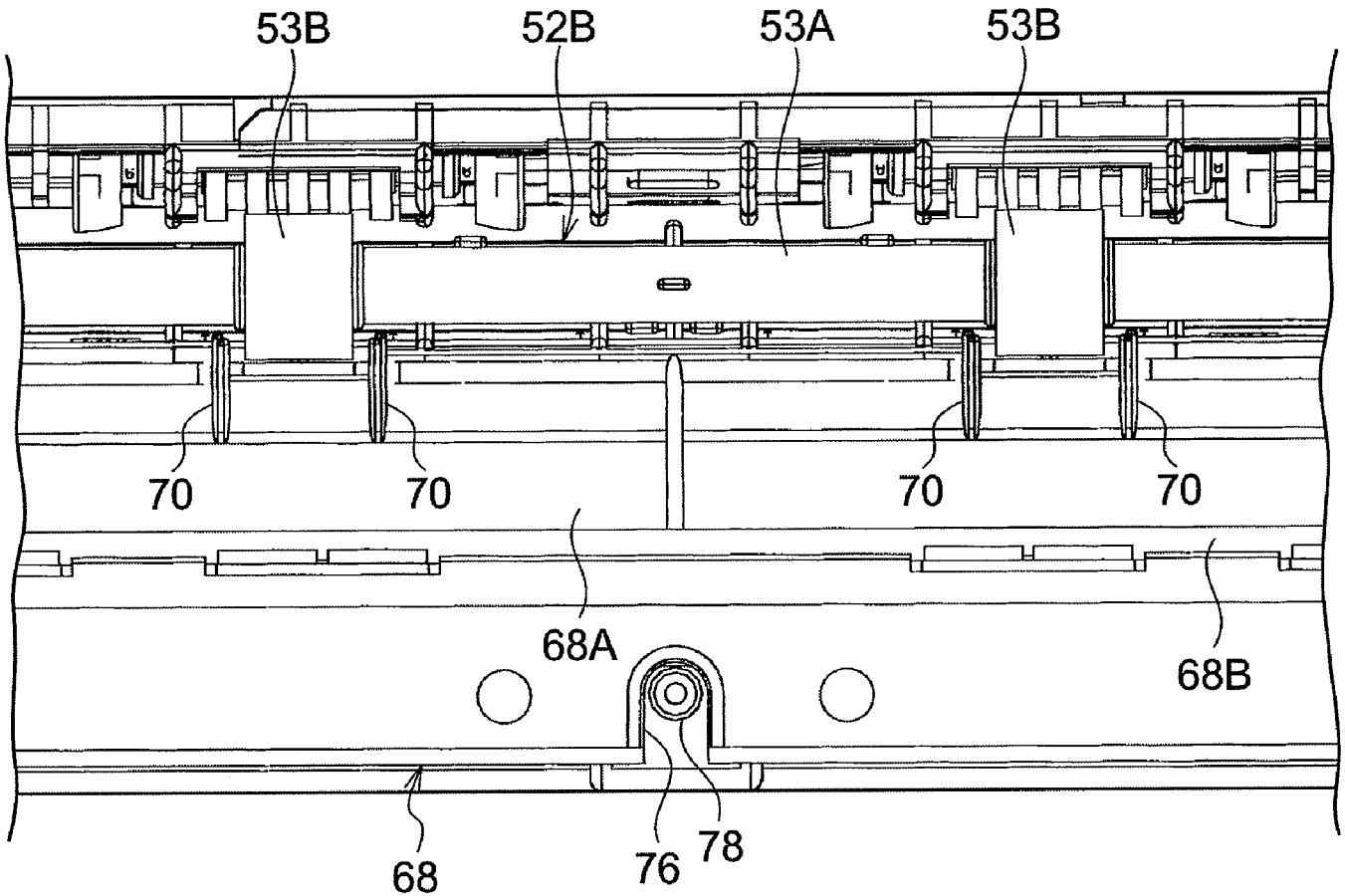
FIG. 9 is a schematic view showing ribs protruding from a first cover according to the exemplary embodiment.

As shown in FIG. 9, in the first cover 68A of the exterior cover 68, ribs 70 are formed so as to hold the roller member 53B from the both sides thereof in the axial direction of the drive shaft 53A. The rib 70 is an example of a projection, which protrudes from the first cover 68A so as to fill a gap between the first cover 68A and the driving roll 52B. Specifically, as shown in FIG. 7, the rib 70 protrudes toward the ejection direction of the recording medium P relative to the outer surface 69A of the first cover 68A (the left side in FIG. 2), and protrudes toward the drive shaft 53A relative to the upper surface 69B of the first cover 68A. According to this configuration, the ribs 70 cover a part (lower portion) of the side surface of the roller member 53B of the driving roll 52B, and extends outside in the radius direction relative to a lower end portion 45 of the outer periphery of the roller member 53B of the driving roll 52B, which is exposed toward the ejecting section 18 side from the first cover 68A.

As shown in FIG. 2, in the main body 62, wirings 72 for supplying electric power to the heat source 64B of the heating roll 64 is disposed in a space 74 between the first cover 68A and the heating roll 64. Thus, the wirings 72 are covered by the first cover 68A so as not to be exposed.

Operation of Exemplary Embodiment

The recording medium P to which the toner image has been fixed by the heating roll 64 and the pressure belt 66 of the fixing device 60 is ejected to the ejecting section 18 by the ejection roll 52.

At that time, the recording medium P is ejected to the ejecting section 18, the rear end (the downstream end in the conveying direction) of the recording medium P may pass over the second cover 68B and thrown to a position reaching the bottom surface cover 13A of the main body 11. In this case, the ejected recording medium P slips down the bottom surface cover 13A due to its own weight.

In the exemplary embodiment, the first cover 68A is positioned lower than the bottom surface cover 13A. Thus, when the recording medium P slips down the bottom surface cover 13A, the recording medium P will not be caught by the first cover 68A, and the rear end of the recording medium P abuts against the first cover 68A, whereby the recording medium P is stored in the ejecting section 18.

Further, the third covers 68C and 68D are positioned outer than the side surface covers 13B and 13C. Thus, when the recording medium P slips down the bottom surface cover 13A, the recording medium P will not be caught by the third covers 68C and 68D, and the rear end of the recording medium P abuts against the first cover 68A, whereby the recording medium P is stored in the ejecting section 18.

In the pair of ejection rolls 52 according to the exemplary embodiment, the driving roll 52B having the drive shaft 53A to which the gear 53C is attached to one end thereof is disposed at the lower side, and the driven roll 52A requiring no gear is disposed at the upper side. According to this configuration, there is no need to ensure a space for disposing a gear at the uppermost portion of the main body 11.

In the configuration in which the driving roll 52B is disposed at the lower side, when the recording mediums P ejected to the ejecting section 18 are stacked to the height reaching the driving roll 52B, the recording medium P tends to drawn (pulled) into the main body 62 due to the recording medium P in the ejecting section 18 contacting the driving roll 52B. However, in the exemplary embodiment, the recording medium P contact the rib 70, whereby the recording medium P is prevented from being drawn into the main body 62.

Further, in the exemplary embodiment, the first cover 68A, the second cover 68B, and the third covers 68C and 68D constituting the exterior cover 68 of the main body 62 serve also as an exterior cover of the main body 11. According to this configuration, in comparison with a configuration in which the exterior cover 68 of the main body 62 and the exterior cover of the main body 11 are separately provided, the number of components can be reduced, and an image forming apparatus can be reduced in size.

In the configuration of a comparative example in which the exterior cover 68 of the main body 62 and the exterior cover of the main body 11 are provided separately, one more cover is added outside the first cover 68A (on the left side in FIG. 2) or between the wirings 72 and the first cover 68A. In contrast, in the configuration of the exemplary embodiment, since the exterior cover 68 of the main body 62 serves as the exterior cover of the main body 11, a space for only one cover may suffice for a space to dispose the cover.

Further, since the exterior cover 68 of the main body 62 serves as the exterior cover of the main body 11, in comparison with a configuration in which the exterior cover of the main body 11 is provided separately from the main body 62, the accuracy of positioning of the exterior cover of the main body 11 with respect to the drive shaft 53A and the roller member 53B of the driving roll 52B is improved. Thus, an interval between the exterior cover of the main body 11 and the drive shaft 53A and the roller member 53B can be set narrow.

Furthermore, since the exterior cover 68 of the main body 62 serving as the exterior cover of the main body 11 has the ribs 70, in comparison with a configuration in which the ribs 70 are provided at the exterior cover of the main body 11 provided separately from the main body 62, the accuracy of positioning of the rib 70 with respect to the drive shaft 53A and the roller member 53B of the driving roll 52B is improved. Thus, an interval between the rib 70 and the drive shaft 53A and the roller member 53B can be easily adjusted.

The invention is not limited to the above exemplary embodiment and may be variously modified, changed, and improved without departing from the scope of the invention defined by the following claims.

What is claimed is:

1. A fixing device comprising:

a main body mounted on an image forming apparatus body;

a fixing member that is included in the main body and that fixes an image to a recording medium;

a pair of conveying rolls that is supported by the main body and that conveys the recording medium to which an image is fixed by the fixing member, the pair of conveying rolls comprising a driven roll and a driving roll disposed under the driven roll; and an exterior portion that is formed in the main body, disposed under the driving roll, forms an exterior face of the main body, and also forms an exterior face of the image forming apparatus body while the main body is mounted on the image forming apparatus body, wherein:

the pair of conveying rolls ejects the recording medium from the main body to an ejecting section, a bottom surface of the ejecting section is formed by a combination of a first bottom surface formed in the exterior portion and a second bottom surface formed in the image forming apparatus body, and a top of the first bottom surface of the exterior portion is positioned lower than a top of the second bottom surface of the image forming apparatus body while the main body is mounted on the image forming apparatus body.

2. The fixing device of claim 1, wherein the driving roll comprises a drive shaft and a roll portion disposed at the drive shaft, and the fixing device further comprises a projection that is formed so as to hold both sides of the roll portion in an axial direction of the drive shaft and that protrudes from the exterior portion so as to fill a gap between the exterior portion and the driving roll.

3. The fixing device of claim 1, wherein the pair of conveying rolls comprises a pair of ejecting rolls that eject the recording medium from the main body to an ejecting section, a side surface of the ejecting section is formed by a combination of a first side surface formed in the exterior portion and a second side surface formed in the image forming apparatus body, and the first side surface of the exterior portion is positioned further to an outer side than the second side surface of the image forming apparatus body while the main body is mounted on the image forming apparatus body.

4. The fixing device of claim 1, wherein:

the pair of conveying rolls comprises a pair of ejecting rolls that eject the recording medium from the main body to an ejecting section, a side surface of the ejecting section is formed by a combination of a first side surface formed in the exterior portion and a second side surface formed in the image forming apparatus body, and the first side surface of the exterior portion is positioned at a position farther than that of the second side surface of the image forming apparatus body, in an axis direction of the pair of ejecting rolls from an axis direction center thereof, while the main body is mounted on the image forming apparatus body.

5. An image forming apparatus comprising:

the fixing device of claim 1;

the image forming apparatus body comprising an image forming section that forms an image which is to be fixed on a recording medium by the fixing member; and an exterior portion that is formed in the image forming apparatus body and forms an exterior face of the image forming apparatus body in combination with the exterior portion of the fixing device.

* * * * *